US007326852B2

(12) United States Patent
Jensen

(10) Patent No.: US 7,326,852 B2
(45) Date of Patent: Feb. 5, 2008

(54) STRING DEVICE

(75) Inventor: Geir Jensen, Trondheim (NO)

(73) Assignee: CNC Cable AS, Verdal (NO)

( * ) Notice: Subject to any disclaimer, the term of this patent is extended or adjusted under 35 U.S.C. 154(b) by 101 days.

(21) Appl. No.: 10/561,193

(22) PCT Filed: Jul. 9, 2004

(86) PCT No.: PCT/NO2004/000214

§ 371 (c)(1),
(2), (4) Date: Jan. 5, 2006

(87) PCT Pub. No.: WO2005/027147

PCT Pub. Date: Mar. 24, 2005

(65) Prior Publication Data

US 2007/0095556 A1 May 3, 2007

(30) Foreign Application Priority Data

Jul. 9, 2003 (NO) ..... 20033139

(51) Int. Cl.
*H01B 7/34* (2006.01)

(52) U.S. Cl. ..... 174/36

(58) Field of Classification Search ..... 174/110 R, 174/113 R, 117 R, 117 F, 117 FF, 120 R, 174/120 C See application file for complete search history.

(56) References Cited

U.S. PATENT DOCUMENTS

| | | | | |
|---|---|---|---|---|
| 2,941,176 | A * | 6/1960 | Jacoby | 338/262 |
| 3,247,020 | A | 4/1966 | Shulver et al. | |
| 3,297,846 | A * | 1/1967 | Peltier | 337/416 |
| 3,683,309 | A * | 8/1972 | Masanao | 338/214 |
| 4,999,460 | A | 3/1991 | Sugiyama et al. | |
| 5,978,549 | A * | 11/1999 | Su | 392/497 |
| 6,353,707 | B1 * | 3/2002 | Loktev et al. | 392/435 |
| 6,493,300 | B2 * | 12/2002 | Failer | 369/53.12 |

FOREIGN PATENT DOCUMENTS

| | | |
|---|---|---|
| DE | 29716038 | 3/1999 |
| EP | 893803 | 1/1999 |
| GB | 2 276 766 A * | 10/1994 |

* cited by examiner

*Primary Examiner*—William H. Mayo, III
(74) *Attorney, Agent, or Firm*—Dennison, Schultz & MacDonald

(57) ABSTRACT

A string device designed for, or combined with elements for, transfer of power and/or signals in applications of monitoring, control, communication, detection, measurement or power distribution. The device provides a passive structural core element and at least two longitudinal active elements, such as a conductors capable of signal transmission or power distribution. The longitudinal active elements are positioned in tracks on or adjacent the surface of the core element, so that they are accessible to surrounding connectors.

21 Claims, 1 Drawing Sheet

STRING DEVICE

BACKGROUND OF THE INVENTION

The invention is a string shaped device, preferably for use as a cable for the transfer of communication signals, control signals, power, or for heat sensing.

The invention is a string shaped device as per claim 1, preferably for use as a cable for the transfer of communication signals, control signals, power, or for heat sensing.

The term "string device" is used herein as a term for various longitudinal, string shaped elements designed to, or to perform in combination with means for the transfer of energy and/or signals relating to monitoring, control, communication, detection, measurement or transport of energy. Samples of such devices may be, cables for signal transmission, control and power supply, linear heat detectors, rails of light, electrical fences, and string like heating elements. The mechanisms of transfer may be based on electricity, optical or fluid mechanics.

DESCRIPTION OF RELATED ART

Linear string or ribbon shaped heat sensors have been in use for a long time in various designs.

From U.S. Pat. No. 1,957,565 (Wheeler) it is known to incorporate a meltable wire into a woven sheath, wherein the wire can melt away when a temperature limit is exceeded.

From U.S. Pat. No. 2,670,419 (Kliever), it is known to make a ribbon device with an embedded low melting point wire, where the device provides a comprehensive and rather expensive laminate of polymer.

From U.S. Pat. No. 3,297,846 (Peltier) it is known to make a ribbon device of electrically insulating material that disintegrates by heating, thereby breaking the electrical flow of current in electrically conducting particles of silver or other material embedded into the insulating material. The design is rather expensive to manufacture and obtrusive when installed.

Flat or ribbon devices in general are designed to be fixed directly to surfaces such as ceilings. This is in conflict with common regulations and standards such as EN 54 that require a specific distance from the surface, to the heat sensing elements for fire detection.

From U.S. Pat. No. 3,406,384 (Hartman et al) it is known to put meltable metals inside a sheath structure. The design is a complicated structure which is less useful in practice, also due to delayed response.

From Norwegian patent application 20001295 (Kristiansen), it is known to use a pure wire of meltable metal, such as tin or similar, as an electric conductor for fire detection, with low temperature fusion. This wire is a string device. Installed in an area for fire monitoring, such a device breaks the flow of current at the melting temperature for actuation of the detection signal. This detector is inexpensive, but involves a series of draw backs such as low tensile strength, large diameter, obtrusive visual appearance, high melting point, difficult wire terminations due to weak resistance to pressure, slow reaction, long installation time, and problems in adapting to the required response temperatures.

In the market of fixed temperature line heat detectors, Protectowire and Alarmline (reg trademarks) are available, based on different principles, but are complicated and/or obtrusive or stiff to handle. The market includes many integrating types of line heat detectors, based on different principles. They are expensive, complicated, and too sensitive for many practical applications.

Therefore, no string device heat detector exists that meets all the requirements of performance, cost, aesthetic and simple installation.

From EP patent application 893803 (Speed France 1998), it is known to manufacture a coaxial cable with a dielectric core and an electrically semi conducting overcoat of metal or carbon powder, for example, for use as an electric fence.

From U.S. Pat. No. 3,247,020 (Shulver 1962), it is known to apply particles of metal in a resin onto glass material as a wire with semi conducting properties, for example, for use as ignition wire on internal combustion engines.

A drawback with string devices, like common cables for the transfer of communication or control signals, or for the transfer of energy, is that the termination of conductors requires tools, and is time consuming.

SUMMARY OF THE INVENTION

The main object of the invention is to provide a string device designed for more efficient use in many applications.

Another object is to provide a string device that is easy to connect to multi conductor terminals or receptacle components of signals or energy, being itself a multi conductor string device. This should be accomplished with a minimum of insulation stripping, if any, and without the use of special tools.

It is an objective to make possible a fire resistant string device of substantial reductions in cost and simplicity as compared to existing fire rated cables, based on a simple manufacturing process.

Furthermore, a specific purpose is to provide a linear heat detector that is inexpensive, easy to install, reliably detects fire, and removing the drawbacks of known line heat detectors as explained above.

A specific purpose is to provide a temperature line heat detector that responds faster than others. It should be unobtrusive and simple to install.

A specific purpose is to integrate a line heat detector with galvanic and fibre optic conventional or leaky conductors into one single cable, in such a way that they also are becoming overheat and fire detection cables.

A specific purpose is to provide a line heat detector which is strong and thin enough to be pressed into slits of the outer sheath of expensive or vital power and communication cables in order to detect fire or overheating that threatens them, for application in both existing and new cable installations.

Another purpose of the invention is to provide an electrically or optically conducting string device that can be used as a communication cable, which is required to be both thin and strong.

Finally, it is a purpose of the invention to provide a plug less cable and connecting system, where cable ends are put directly into receptacles, thus by itself substituting conventional plugs.

The invention is directed to a string device having a passive structural core element formed of an electrically insulating material and which is of generally cylindrical or polygonal cross section, and at least two active longitudinal elements, each of the elements being capable of transferring at least one of an electrical signal, an optical signal, a pneumatic signal and electrical power. The linear, active performing element may be one or more conductors positioned in linear slits in the core element, as the conductors are accessible from the outer surface of the core.

The conductor may be a metallic coating, insulated conductor, a fibre optic conductor, or a metal with low melting temperature for the transfer of communication signals, control signals or power.

String devices may be applied as heat detectors by the core, comprising an electric or optical, non-conductive material, which is structural resistant for ambient temperature in a certain area, above a desired alarm temperature, and has at least one track of a conductive layer or a thread of a material which become discontinued and/or non-conductive at a threshold temperature. The conducting material may be an alloy of low melting temperature, such as Wood's metal or other melting metals polymers or optical signal fibres that break the signal path at a low threshold design temperature. It is beneficial to have two or more longitudinal slits with separated conductors.

Especially good performance of a string device is obtained when the core element has slits which form protected paths for fitting electrical, fibre optic, or fluid mechanical conductors. The slit cross sections may be C shaped, and can be expanded for insertion of linear conductor in each slit.

The core may at its perimeter, have a longitudinal slit or an expanded ribbon for indication and positioning control by connection. The core may be of a ribbon design with the longitudinally slits arranged on one side. The core cross section may be circular or elliptical with the slits arranged at the perimeter, as it may have 3-8, preferably 5 slits. The core may be covered by an outer sheath for insulation.

The invention involves a connector system for the string device, according to the invention. The system includes at least one receptacle contact for at least one end of the string device, with one or more contacts in the receptacle to connect to corresponding conductors of the string device. The receptacle/receptacles comprises at least one electric conducting contact rail, having a radial inwards directed edge which may provide mechanical contact with the conductor of the string device. The receptacle may also be a photo coupler, particularly a light transmitter or photo cell, which can communicate with an optical or nano-conductor on the string device. The receptacle element may be a cylinder shaped for connection of two string devices. The cylindrical receptacle may have protruding contacts for at least one contact rail. In connection with the receptacle or receptacles, there may be arranged knife like grips which grabs the outer parts of the structure element and prevents the string device from sliding out. The receptacle may be aligned to the outer side of the string device, to provide support for this during insertion and receiving.

The photo coupler is arranged exterior of the receptacle, by use of an optical connection through a slit.

The receptacles may be arranged to be aligned for pressing the connector or connectors to contact against the conductor, by use of a crimp tool.

The manufacture of a string device, according to the invention, may be accomplished by simple processes, and by using inexpensive and environmentally benign materials.

Line heat detectors may be manufactured with a diameter down to 200 micron. This result in visual advantages, due to the heat detector is becoming hardly visible in most applications.

Line heat detectors may be manufactured with high tensile strength. This ensures flexibility in installation as they allow pulling after penetration of partitions, allow spring loaded installation, allow simple fixing equipments, and allow one hand single operation to terminate ends.

One benefit of the string device as a line heat detector is that a low and threshold response temperature which can be determined from a desired temperature below 40 degrees Celsius and up to all standard thresholds for heat detectors.

A string device according to the invention may be applied as a cable in a new way. The cable conductors now run at the perimeter of a dielectric core, and the combination becomes a single, compact unit. This means that the dielectric is primarily in the centre of the conductors, and the dielectric is the structural element, that the dielectric material may be very thin and very strong, the cable may be, but not necessarily, covered by a dielectric outer sheath, that all conductors have fixed interrelated positions, that the conductors of the cable do not have to be stripped of insulation before connecting and that the connection of all conductors to all contacts of a receptacle takes place by manually feeding any cable end into a receptacle by a one handed single operation.

The cable is characterized as being typically thin, round, and flexible. The invention, in the form of communication cables, is characterized by all protruding parts at the outer surface being dielectric, and by all conductors being accessible for contact through slits. An outer protecting sheath may be added when applicable, and ends are easily stripped before direct connection as described above.

The invention represents a type of cable which can be manufactured stronger, and with a smaller outer diameter, compared to existing cables with the same number of conductors because a core, such as glass fibre, Kevlar (trademark) or similar, may be manufactured first, and conductors may be molten or pressed it.

The cable design may involve one or several paths of low melting temperature conductors for fire detection. It may be used as a communication cable without such melting conductors, and with conductors of aluminium, copper, silver or optical fibres (conventional fibres or evanescent coupled nano fibres). Applications may be electrical panels, equipment cubicles and vehicles.

A typical application of the invention is wired alarm systems. Small, private alarm systems typically use cables of 6 or more conductors which are cumbersome to connect to the panel and detectors, and those cables do not offer line heat detection. The invention allows each point between any system components along the cable path to be monitored for fire. The inverted cable is installed into attics, external parts of building eaves, free standing roofs, staircases or various rooms that smoke detectors are not installed in due to cost, risk of nuisance alarms or a harsh climate, resulting in a complete and cost effective way of monitoring fire in all parts of buildings.

The dielectric, structural core of the cable may typically be made of glass fibre. It may be used for communication by optical fibres as well. If fire melts the outer coating, triggering an alarm, the core may remain intact to ensure continued optical signal transmission as it may resist high temperature. Copper conductors, optical fibres, and a low melting point conductor may be combined in one cable to ensure signal transmission if, for example lightning that destroy the cobber conductors and melt the detection conductor.

BRIEF DESCRIPTION OF THE DRAWINGS

The invention is illustrated by the drawings, where

FIG. 1 show a cross section of a simple embodiment of the invention, the core being circular and the string device used for heat detection, FIG. 2 show a cross section of another embodiment of the invention, with four conductor tracks on a star shaped cross section core, for use either as a heat detector or communication cable, FIG. 3 show a cross section of a third sample embodiment of the invention, with a ribbon shaped core of three tracks available for electrical or optical conductors, FIG. 4 show a schematic cross section of a circular string device incorporating five C shaped tracks available for conductors, inserted into a cylindrical receptacle designed according to the invention, while

DESCRIPTION OF THE PREFERRED EMBODIMENTS

Figure 1:
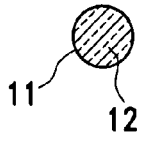

FIG. 1 show a sample embodiment of the invention as a string line heat detector 11, with a dielectric fibre core 12. The core 12 may be made of glass fibre with a diameter of 0.1 to 0.5 mm. It is important that the core 12 is dielectric or some other material with less conductivity than metal. The core, elsewhere referred to as the structural element, preferably must have low heat conductivity, as this reduces the time to respond to fire.

The coating of the core 12 is a conducting material of low melting point, hereafter referred to as 'melting conductor'. In the sample, Wood's metal (49.5% bismuth, 27.3% lead, 13.1% tin, 10.1% cadmium) is applied. This alloy melts at 70 degrees Celsius. Depending on the required alarm threshold, bismuth alloys or other alloys with melting points from below 40 degrees Celsius up to several hundred degrees Celsius are used.

Figure 2:
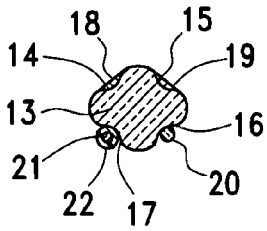

FIG. 2 shows another example of an embodiment of basically circular cross section, with a core 13 of glass fibre or similar in a blunt star shape, to make four longitudinal valley like tracks 14, 15, 16, 17. In each of the tracks there is arranged or fixed a conductive track. Four examples are shown:

First, a low melting point alloy 18 is located in track 14. The conductive alloy 18 may be used as a heat detector or electrical conductor.

Then, a layer 19 of heat resistant metal is located in track 15, which may be, for example, copper. Layer 19 may be used as an electrical conductor. The layer 19 of heat resistant or low melting point alloy may be evenly coated, or be thicker at the bottom of the track 15. A low melting point layer should, preferably, be as thin as possible and have as large a surface as possible to further enhance responsiveness to overheating or fire. The conductor cross sectional area depends on the string device length, monitoring mode, and application.

Further, a conductor of light 20, in track 16, is a conventional optical fibre, or a nano fibre, to transmit light signals by conventional mode or by evanescent coupled nano fibres.

Finally, an insulated copper wire or optical fibre 21 is shown, with the insulating layer 22 glued to track 17.

The string device in FIG. 2 is alternatively accomplished by a number of tracks with melting conductors. These can be used in alarm systems. The system monitors each track, and algorithms are used for assessing signals as conductors break. Such a system may be used to evaluate failure signals. Sudden circuit breaks in all conductors may indicate mechanical failure, while successive circuit breaking may indicate a real fire of intensity and development.

In the above three examples, the string device is designed with a dielectric core that does not transmit signals or power, and one or more conductors accessible at the perimeter of the string. The invention simplifies connecting and disconnecting, as it is known from previous conventional wiring systems or string devices.

Figure 3:
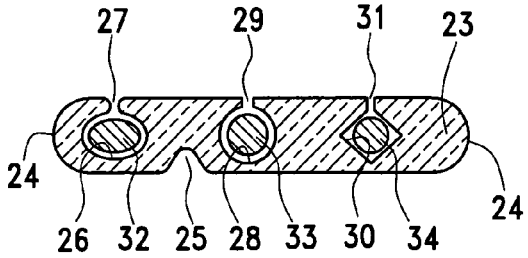

FIG. 3 shows a ribbon shaped embodiment of the invention. The example shows a ribbon shaped structural element 23 with rounded edges 24 and a track 25 on the bottom side for alignment to receptacles. On top side, several options of longitudinal tracks are shown side by side; a track 26 of elliptical cross section accessible through slit gap 27, a track 28 of circular cross section accessible through slit gap 29, and a track 30 of square cross section accessible through slit gap 31. In practice, tracks may be uniform in a single string device, so that the illustration primarily shows the various options.

In the tracks 26, 28, 30 a conductor 32, 33, 34 is shown in each track. The conductors 32-34 may be of different shape, structure and function. By principle, any kind of single conductor, with or without insulation, may be used, being of a metallic or optical medium. Copper conductors may be protected by glass fibre which offers high resistance in fires. One may put twisted pairs in tracks to provide increased shielding.

Figure 4:
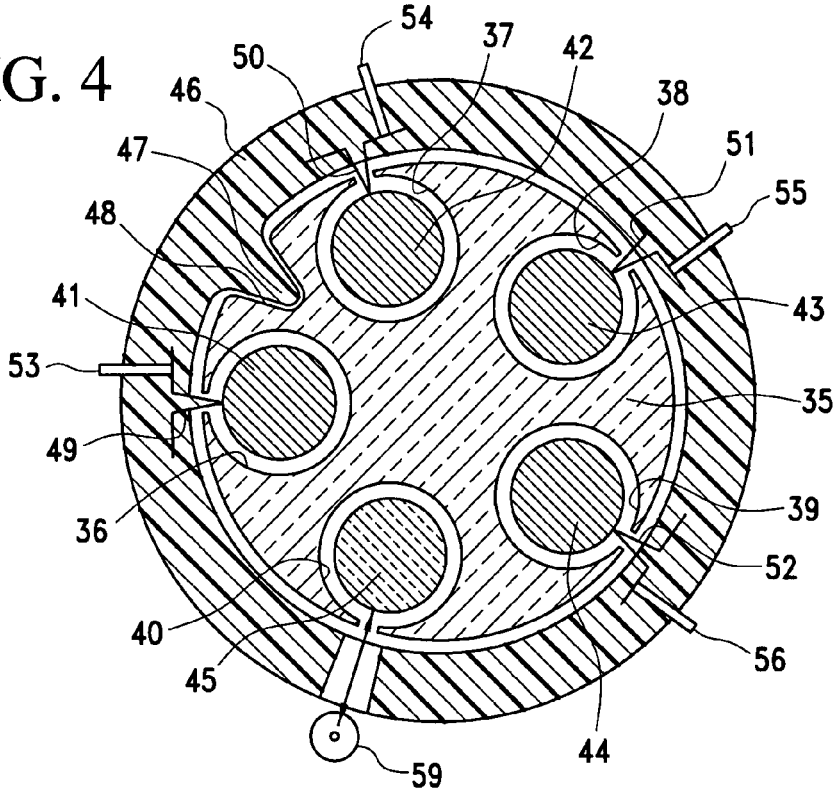
Figure 5:
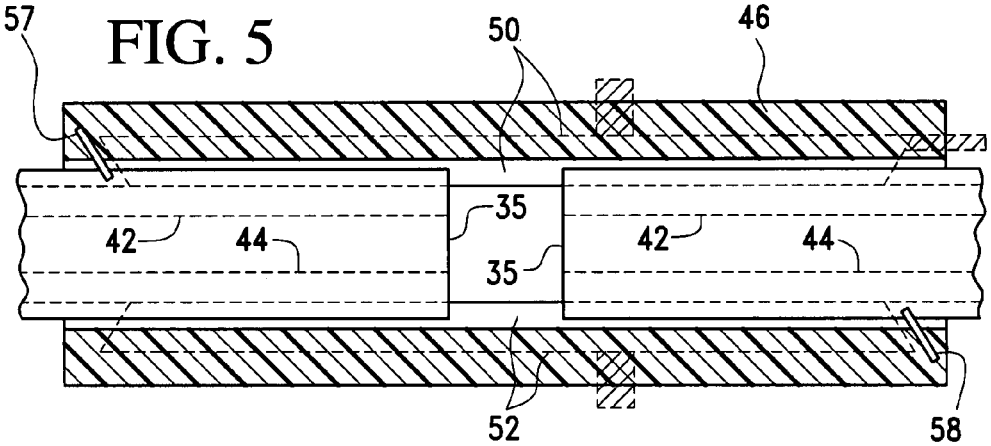
FIG. 5 shows a schematic longitudinal cross section through the receptacle of FIG. 4.

FIGS. 4 and 5 show a further embodiment of a string device according to the invention, and an embodiment of the connector system according to the invention. The string device in this case is basically a circular core 35 with 5 C shaped tracks 36-40 at the perimeter. Each track 36-40 incorporates a conductor 41-45 in a similar way as per FIG. 3. The track slits in 36-40 is designed with tight lips which are just flexible enough to allow pressing in the conductors 41-45.

Sample of conductors are copper, aluminium, full or semi conducting polymers and optical fibres including nano fibres.

FIGS. 4 and 5 also show an example of receptacle for connection according to the invention. 'Receptacle' refers to various forms of terminating conductors to splices, circuit boards or other hardware components where the main function is to transmit signals or power between conductors and equipment, such as in vehicles, electrical panels, and alarm systems.

The example of a connector system is a cylindrical splice receptacle 46, shown with a string device inserted at each end. The receptacle 46 is basically shaped as a cylinder with an internal alignment ridge 47 to couple with track 48 in the string device cores 35. Corresponding to each conductor 36-39, longitudinal contacts are shaped as knives 49-52, so as to both cut into slits and to make sustained contact with the conductors, in order either to splice the conductor within the two inserted string devices, or to provide an external connection and connection point, possibly both.

The example shows a receptacle with electrically conducting terminals 53-56, each of which is in contact with a respective 'knife' element 49-52.

At each end of the receptacle 46, one or several hooks 57 and 58 are arranged, to prevent the string device being unintentionally pulled out of the receptacle. At track 40, a fibre optical transceiver device 59 is connected to an external signal circuit which picks up or sends signals via the fibre optic conductor 45.

The string device, may be insulated by an outer sheath, but is not necessary where there is no contact danger voltage. The conductors have fixed interrelated positions. Use without an outer sheath means that the cable does not have to be stripped before connection, and all conductors will meet up to the corresponding contacts of a receptacle when a cable end is manually pushed into the multi contact receptacle in one single operation. Receptacles have knives or spring loaded contact elements as described above that positively contact the respective conductors through the slits. Receptacles may be designed two-sided, forming splices or patch cables for line heat detectors or cables of short lengths, or designed as adapters to conventional terminals. Receptacles may be designed so that a cable may be pulled through it without breaking any circuit. Thus allowing and allowing components to be moved along the cable while remaining fully operational.

The string device and receptacle have corresponding non symmetric cross sections that align conductors, allowing them to fit but one way, so that wrong connections are impossible and there is no need for color coding conductors. The cable is characterized by that it may be small, circular and flexible.

The string device according to the invention, when applied as a cable, provides much stronger protection against bending of the plug pins, than for conventional cables with conductor cores. This inherent strength is further enhanced with example embodiments shown in FIGS. 3 and 4. The connection system makes use of a crimping tool to connect multi-conductor cables.

The invention allows for simplification of connecting fibre optic cables. Light transceivers may be positioned in a star shape around the perimeter of the multi-conductor string device. Fibres may be tightly spaced and not interfere with each other.

The string device, according to the invention, lends itself well fitted as cables for vehicles, electrical installations, for example switch boards and termination cabinets.

Processing

Manufacturing the string device as shown in FIGS. 1 and 2, may be accomplished by pulling the core, the structural element, through a die of proper dimension and cross sectional shape from liquid silica or spun fibres. It is then coated with a melting alloy by known processes for metal coating of fibres.

Another technique is sputter deposition by magnetrons. Other known techniques for metal coating are, but not limited to those that, utilize evaporation, chemical decomposition and electro deposition.

By a special process irregular cross section string devices are shaved on protruding ridges after the application of the metal coating, leaving longitudinal tracks of conducting and non conducting material side by side, effectively creating discrete conducting tracks, such as those according to FIG. 2.

A string device according to the invention, designed as a heat line sensor, may be pressed into a slit, or glued upon, the dielectric outer sheath of known power cables.

The invention may also be realized by tube conductors which operate fluid mechanically, i.e. pneumatic or hydraulic.

The invention claimed is:

1. A string device for applications of monitoring, control, communication, detection, measurement or power distribution, comprising:

a passive, structural core element formed of an electrically insulating material and which is of generally cylindrical or polygonal cross section; and at least two active longitudinal elements, each of said elements being capable of transferring at least one of an electrical signal, an optical signal, a pneumatic signal and electrical power;

the core element having an outer surface with at least two tracks arranged on said outer surface or internally adjacent said outer surface, in which tracks said longitudinal elements are disposed, with at least one of said elements being disposed in each of said tracks, the active longitudinal elements being constructed and arranged to be accessible from an the outer surface of the string device.

2. A string device according to claim 1, wherein the conductor is a metal coating, an insulated wire, a fiber optic conductor, or a low melting point metal, for the transfer of communication signals, control signals or power.

3. A string device according to claim 1, for use as a heat detector, wherein the core comprises a material which is stable at surrounding temperatures up to a range above a set threshold temperature, and which contains at least one active element of wire or conducting material which breaks and/or becomes non-conductive at a set threshold temperature.

4. A string device according to claim 3, wherein the conducting material is a low melting alloy, polymer, or optical fiber which discontinues the signal flow at a set threshold temperature.

5. A string device according to claim 3, wherein the core comprises at least two longitudinal ribbons, in which are arranged separate conducting tracks.

6. A string device according to claim 1, wherein the tracks comprise internally disposed longitudinal conduits for the longitudinal elements.

7. A string device according to claim 6, wherein the conduits are C shaped and have a slit gap which can be widened for insertion of a longitudinal element therein.

8. A string device according to claim 6, wherein the core element is ribbon shaped with longitudinal tracks grooved into one side.

9. A string device according to claim 6, wherein the core element has a circular or elliptical cross section and the longitudinal tracks are arranged at a perimeter.

10. A string device according to claim 9, wherein the core element has 3 to 8 tracks.

11. A string device according to claim 6, additionally comprising an outer insulating sheath.

12. A string device according to claim 1, additionally comprising a longitudinal track, or a ridge at the outer surface of the core element for indication and positioning when connecting.

13. A connector system, comprising:

a string device according to claim 1;

at least one receptacle constructed and arranged for receiving one end of a string device, and having an inner surface incorporating therein at least a contact corresponding to each of said active longitudinal elements to provide a signal or current connection therewith.

14. A connector system according to claim 13, wherein the at least one receptacle includes at least one longitudinal electrical contact knife having an edge pointing inwardly and making contact with a corresponding active element of the string device.

15. A connector system according to claim 13, wherein the receptacle is a photo coupler, including at least one of a light transmitter and a receiver, constructed and arranged to communicate with an optical fiber or nano fiber longitudinal element.

16. A connector system according to claim 15, wherein the photo coupler is positioned externally on the receptacle and communicates with the optical fiber through a slit.

17. A connector system according to claim 13, wherein the receptacle is cylindrical, and constructed and arranged to splice together two string devices.

18. A connector system according to claim 17, wherein the receptacle comprises radially protruding pin terminals for at least one contact knife.

19. A connector system according to claim 13, wherein the receptacle comprises angled sharp knives that penetrate into outermost insulated portions of the string device to prevent separation from the receptacle.

20. A connector system according to claim 13, wherein the receptacle is constructed and arranged to fit the string device and aid the insertion and completion of contacts.

21. A connector system according to claim 13, wherein the receptacle is constructed and arranged to contact conductors of the string device by crimping.

* * * * *